United States Patent [19]

Horodysky et al.

[11] Patent Number: 4,787,996

[45] **Date of Patent: * Nov. 29, 1988**

[54] MANNICH BASE OIL ADDITIVES

[75] Inventors: Andrew G. Horodysky, Cherry Hill; Robert M. Gemmill, Jr., Pitman, both of N.J.

[73] Assignee: Mobil Oil Corporation, New York, N.Y.

[ * ] Notice: The portion of the term of this patent subsequent to Aug. 2, 2000 has been disclaimed.

[21] Appl. No.: 38,468

[22] Filed: Apr. 14, 1987

Related U.S. Application Data

[60] Continuation of Ser. No. 868,181, May 21, 1986, abandoned, which is a continuation of Ser. No. 705,867, Feb. 28, 1985, abandoned, which is a continuation of Ser. No. 485,525, Apr. 15, 1983, abandoned, which is a division of Ser. No. 329,773, Dec. 11, 1981, abandoned.

[51] Int. Cl.[4] ..... C10M 133/00

[52] U.S. Cl. ..... 252/51.5 R; 44/53; 44/56; 44/75

[58] Field of Search ..... 44/53, 56, 75; 252/404, 252/51.5 R

[56] References Cited

U.S. PATENT DOCUMENTS

| | | | |
|---|---|---|---|
| 2,353,192 | 7/1944 | Saregent et al. | 252/51.5 R |
| 2,453,850 | 11/1948 | Mikeska et al. | 44/75 |
| 2,962,442 | 11/1960 | Andress, Jr. | 44/62 |
| 2,984,550 | 5/1961 | Chamot | 44/62 |
| 3,269,810 | 8/1966 | Chamot | 44/75 |
| 3,725,480 | 4/1973 | Traise et al. | 252/51.5 R |
| 3,985,802 | 10/1976 | Piasek et al. | 252/51.5 R |
| 4,083,699 | 4/1978 | Chibnik | 44/75 |
| 4,116,644 | 9/1978 | Jackisch et al. | 44/75 |
| 4,193,884 | 3/1980 | Lee | 252/51.5 R |
| 4,231,759 | 11/1980 | Undelhofen et al. | 44/75 |
| 4,242,212 | 12/1980 | Hanson | 44/75 |
| 4,259,086 | 3/1981 | Machleder et al. | 252/51.5 R |
| 4,320,021 | 3/1982 | Lange | 44/75 |
| 4,396,517 | 8/1983 | Gemmill, Jr. et al. | 252/51.5 A |

*Primary Examiner*—Mark L. Bell
*Assistant Examiner*—Jerry D. Johnson
*Attorney, Agent, or Firm*—Alexander J. McKillop; Michael G. Gilman; Charles J. Speciale

[57] ABSTRACT

Mannich bases, prepared using a phenol substituted with a medium length branched alkyl chain, the alkyl being derived from a 1-olefin oligomer. These Mannich bases act as friction-reducing agents in lubricant and liquid fuel compositions.

16 Claims, No Drawings

MANNICH BASE OIL ADDITIVES

CROSS REFERENCE

This is a continuation of application Ser. No. 868,181 filed on May 21, 1986, which is a continuation of application Ser. No. 705,867 filed Feb. 28, 1985, which is a continuation of application Ser. No. 485,525, filed Apr. 15, 1983, which is a division of application Ser. No. 329,773 filed Dec. 11, 1981, all of which are now abandoned.

BACKGROUND OF THE INVENTION

1. Field of the Invention

The invention relates to novel additives and to lubricant and liquid fuel compositions containing same. More particularly, it relates to additives made from medium-chain 1-olefin oligomer alkylated phenols, aldehyde and hydrocarbyl amines.

2. Discussion of the Prior Art

Much effort has been directed to providing a lubricant which will permit present-day automotive engines to be operated at a high level of efficiency over long periods of time. One difficulty encountered is that lubricating oils tend to deteriorate under the conditions of use, resulting in the formation of sludge, lacquer, and resinous materials, which adhere to the engine parts and lower the operating efficiency of the engine.

Also, friction is a problem any time two surfaces are in sliding or rubbing contact. It is especially significant in an internal combustion engine and related power train components, because loss of substantial amount of the theoretical mileage possible from a given quantity of fuel is traceable directly to friction. The Mannich bases of this invention unexpectedly are effective in decreasing this friction.

Mannich bases have been used as lubricating oil and fuel additives. For instance, U.S. Pat. No. 3,368,972 teaches the use of a conventional Mannich base made using a phenol containing a high molecular weight alkyl substituent as detergents in engine oils. U.S. Pat. No. 2,459,114 also discloses the use of conventional Mannich bases, but made using short-chain, alkyl-substituted hydroxy-aromatics or a relatively high molecular weight straight chain chlorinated aliphatic hydrocarbon.

U.S. Pat. No. 3,649,229 teaches the same compounds as fuel additives.

It has been found that the additives disclosed in the three mentioned references have no substantial friction-reducing properties.

SUMMARY OF THE INVENTION

In accordance with the invention, there are provided compounds made by reacting a 1-olefin oligomer-substituted phenol, in which the oligomer is a branched chain alkyl, an aldehyde and a hydrocarbyl amine. The invention further provides a lubricant or fuel composition.

DESCRIPTION OF SPECIFIC EMBODIMENTS

The compositions of this invention are made from (1) a medium molecular weight alkyl-substituted phenol, wherein the alkyl substituent is a branched oligomer made from a 1-olefin and having no more than an average of 40 carbon atoms, (2) an aldehyde and (3) a hydrocarbyl amine wherein the respective molar ratio of reactants is 1.0:1.0–2.0:1.0–2.0. The reaction involved, in one of its aspects, can be represented by the following:

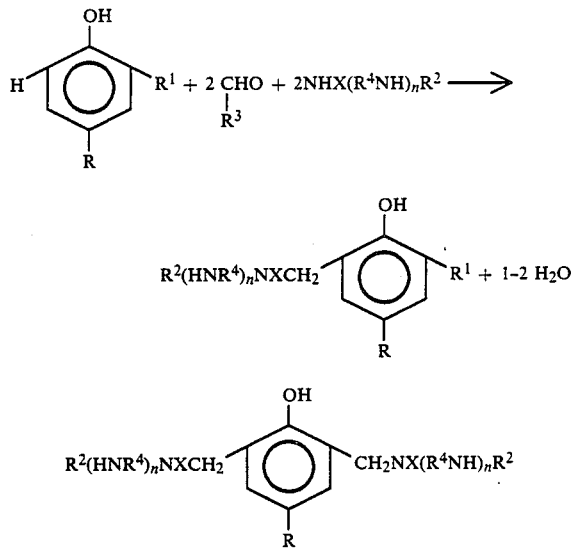

(formed when $R^1$ = H)

wherein R is a branched alkyl group having from about 16 to 40 carbon atoms derived from a 1-olefin having from 8 to 12 carbon atoms, $R^1$ is hydrogen or R, $R^2$ is a hydrogen or hydrocarbyl group, preferably alkyl, containing 6 to 18 carbon atoms, X is hydrogen or $R^2$, $R^3$ is hydrogen or a hydrocarbyl group containing 1 to 10 carbon atoms, preferably hydrogen, $R^2$ and $R^3$ can also contain hydroxyl, halogen and the like, $R^4$ is alkylene having 1 to 5 carbon atoms and n is from 1 to 10. The reaction can be run at from about 60° C. to about 130° C., using a hydrocarbon solvent. Such solvents can include benzene, xylene, and toluene. The water formed during the reaction is removed by azeotropic distillation while refluxing the mixture.

The phenols contemplated for use in forming the alkylated phenols and making the products of this invention include phenol itself and cresol, xylenol, hydroxydiphenyl, amylphenol, benzylphenol, alpha and beta naphthols, and the like. Specific members include decene dimer phenol, decene trimer phenol, octene dimer and trimer phenol, dodecene dimer and trimer phenol and including mixtures of these.

Aldehydes contemplated by the present invention are the aliphatic aldehydes, typified by formaldehyde or paraformaldehyde, acetaldehyde and aldol(β-hydroxybutyraldehyde); aromatic aldehydes, such as benzaldehyde and heterocyclic aldehydes, such as furfural. The $R^3$ group of the aldehyde may contain a substituent group such as hydroxyl, halogen, nitro and the like. In short, any substituent can be used which does not take a major part in the reaction. Preference, however, is given to the aliphatic aldehydes, formaldehyde being particularly preferred.

The amines and the mixtures thereof contemplated herein are preferably those which contain a primary amino group. It is contemplated that these preferred amines include saturated and unsaturated aliphatic primary monoamines containing 6 to 18 carbon atoms. They specifically include such typical amines as polyalkenepolyamines, such as those of the formula $NH_2(R^4NH)_nH$ wherein $R^4$ is an alkylene group having from 1 to 5 carbon atoms and n is from 1 to 10. Examples of these are dimethylenetriamine, diethylenetriamine, triethylenetetramine, tetraethylenepentamine, hexaethyleneheptamine and the like. Cyclic amines are also contemplated and include cyclohexylamine and dicyclohexylamine.

Still more specifically, the amines contemplated are cocoamine, oleylamine, octylamine, nonylamine, decylamine, cyclooctylamine, dodecylamine, tetradecylamine, hexadecylamine, octadecylamine, stearylamine, laurylamine, soyamine, dibutylamine, dioctylamine and other secondary amines, ethanolamine, diethanolamines and other alkanolamines.

The alkyl phenols of this invention may be made by reacting 0.1 to 10 moles of a phenol with 1 mole of a 1-olefin oligomer in the presence of an alkylation catalyst, such as a complex of $BF_3$ (including the etherate, phenolate or phosphate complexes), $BF_3$ or HCl gas with $AlCl_3$, at 80° C. to 250° C. This process is particularly effective when conducted by reacting 1 to 1.5, or especially 1.25 moles, of phenol to 1 mole of an olefin oligomer in the presence of a $BF_3$ phenolate at about 150° C. The product is conveniently dissolved in an aromatic solvent and then washed with water to remove unreacted components. Upon filtration and removal of the aromatic solvent by distillation; the product, a clear viscous oil, remains.

The Mannich bases formed from the specified reactants have been found to have not only generally applicable anti-friction qualities, but also the ability to reduce fuel consumption in an internal combustion engine.

The additives can be used in a wide variety of systems at from about 0.1% to about 10% by weight, but preferably about 0.10% to about 4.0%.

Transmission fluids illustrate one system in which the present additives can be used. These are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2: RR 1005 on "Automatic Transmission Fluid/Power Transmission Fluid Property and Performance Definitions" Specifications for low temperature and aircraft fluids are defined in U.S. Government Specification MIL-H-5606A. In addition, the oxidation and corrosion resistance of functional fluids such as hydraulic fluids can be improved by the adducts of the present invention.

Of particular significance, in accordance with the present invention, is the ability of the additives to improve a variety of properties of lubricants and liquid fuels hydrocarbon and alcoholic fuels and mixtures. They include the wear resistance or friction qualities of lubricated parts and improved resistance to oxidation and corrosion of oleaginous materials such as lubricating media. These preferably comprise liquid oils, in the form of either a mineral oil, a synthetic oil or mixtures thereof, but also may be a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SUS at 100° F. to about 6000 SUS at 100° F., and preferably, from about 50 to about 250 SUS at 210° F. These oils may have viscosity indexes ranging to about 100 or higher. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in greaseforming quantities in am amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where the use of synthetic oils, or greases therefrom is desired in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl)ether, phenoxy phenylethers.

The liquid fuels include hydrocarbon fuels such as gasoline, diesel fuel and the like, alkanol fuels, such as methanol and ethanol. "Fuels" also includes mixtures of hydrocarbon and alkanol fuels. Fuel compositions will contain from about 5 to about 500 pounds of additive per 1000 barrels of fuel, preferably about 20 to about 120 pounds per 1000 barrels.

It is to be understood that the compositions contemplated herein can also contain other materials. For example, other corrosion inhibitors, extreme pressure agents, antiwear agents, defoamants, detergents, dispersants, and the like can be used, including phenates, sulfonates, zinc dithiophosphates and succinimides. These materials do not detract from the value of the compositions of this invention. Rather, the materials serve to impart their customary properties to the particular compositions in which they are incorporated.

The following examples will illustrate the invention. They are illustrative only, and are not intended to limit the invention.

EXAMPLE 1

Decene Trimer Alkylated Phenol-Cocoamine-Formaldehyde Condensation Product

Approximately 42 g (about 0.2 moles) of cocoamine, 72 g of 1-decene trimer alkylated phenol, 6.5 g (about 0.2 moles) of paraformaldehyde and 100 g of benzene solvent were placed in a 500 ml glass reactor fitted with a nitrogen inlet, stirrer, thermometer, Dean-Stark tube and condenser. The reaction mixture was heated with agitation using a nitrogen blanket to a maximum temperature of about 115° C. until water evolution stopped. The solvent was removed by vacuum distillation. The product was filtered through diatomaceous earth at about 70° C. and was collected as a clear, amber colored liquid.

EXAMPLE 2

Decene Dimer Alkylated Phenol-Cocoamine-Formaldehyde Condensation Product

Approximately 45 g (about 0.2 moles) of cocoamine, 100 g of 1-decene dimer alkylated phenol, 6.5 g (about 0.2 moles) of paraformaldehyde and 75 g of benzene solvent were placed in a reactor equipped as described in Example 1. The reaction mixture was heated with agitation and a nitrogen blanket to a maximum temperature of 120° C. over a period of 3 hours until water evolution stopped. The solvent was removed by vacuum distillation. The product was filtered through diatomaceous earth at about 70° C. and was collected as a clear, amber colored liquid.

EXAMPLE 3

One mole of polybutylphenol (made by reacting phenol with polyisobutylene in the presence of $BF_3$ catalyst), 0.58 mole of tetraethylenepentamine and 1.95 moles of paraformaldehyde were reacted as described in Examples 1 and 2, except that the product was diluted 50:50 with a process oil.

EVALUATION OF THE COMPOUNDS

The compounds of Examples 1, 2 and 3 were evaluated in a low velocity friction apparatus (LVFA) in a fully formulated 5W-20 synthetic engine oil containing an additive package including antioxidant, dispersant and detergent. The test compound was 4% of the total weight of oil.

Description

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X–Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml of test lubricant are placed on the LVFA. A 240 psi load is applied, and the sliding speed is maintained at 40 fpm at ambient temperature for a few minutes. Plots of coefficients of friction ($U_k$ vs. speed were taken at 240, 300, 400, and 500 psi. Freshly polished steel specimens are used for each run. The surface of the steel is parallel ground to 4 to 8 microinches. The results in Table 1 refer to percent reduction in coefficient of friction compared to the unmodified oil. That is, the formulation mentioned above was tested without the compound of this invention and this became the basis for comparison. The results were obtained at 250° F. and 500 psi. Following are the results:

TABLE 1

Friction Reduction Properties
Low Velocity Friction Apparatus Test

| Medium and Additive | Additive Conc. Wt. % | Percent Reduction in Coefficient of Friction, % 5 Ft./Min. | 30 Ft./Min. |
|---|---|---|---|
| Base Oil only | 0 | 0 | 0 |
| Example 1 | 4 | 20 | 25 |
| Example 2 | 4 | 18 | 23 |
| Example 3 | 4* | 0 | 0 |

*8% of 50% active product

The results clearly show substantial friction-reducing properties for the 1-olefin oligomer derived alkylated phenol Mannich base condensation product. Example 3, which represents products like those disclosed in U.S. Pat. No. 3,368,972, has no friction reducing properties as measured in this test.

The products of Examples 1 and 2 were blended into a 200" solvent paraffinic neutral lubricating oil samples of which were evaluated for oxidative stability using the Catalytic Oxidation Test by placing them in an oven at 325° F. for 40 hours.

The samples were in the presence of the following metals known to catalyze organic oxidation:

a. 15.6 sq. in. of sand blasted iron wire;
b. 0.78 sq. in. of polished copper wire;
c. 0.87 sq. in. of polished aluminum wire;
d. 0.167 sq. in. of polished lead surface.

Dry air was passed through the test samples at a rate of about 5 liters per hour for the full 40 hours. The results demonstrate the antioxidant properties incorporated into these friction-reducing compositions.

TABLE 2

Oxidation Characteristics
Catalytic Oxidation Test, 40 Hours @ 325° F.

| Medium and Additive | Additive Conc. Wt. % | % Increase in Viscosity of Oxidized Oil Using KV @ 100° C. | Neutralization Number |
|---|---|---|---|
| Base Oil only | 0 | 67 | 3.62 |
| Example 1 | 1 | 33 | — |
| Example 2 | 1 | 25 | 3.20 |

The results clearly show substantial antioxidant properties for the 1-olefin oligomer derived alkylated phenol Mannich base condensation product.

We claim:

1. A method for reducing the coefficient of friction of a liquid lubricating oil which comprises adding to such an oil a coefficient of friction-reducing amount of the product resulting from reacting an aldehyde;

at least one amine selected from the group consisting of primary amines containing from 8 to 18 carbon atoms and polyalkylenepolyamines of the formula $$NHX(R^4NH)_nR^2$$

wherein $R^2$ and X are selected from the group consisting of hydrogen, a hydrocarbyl group and a hydroxyhydrocarbyl group, either containing 6 to 18 carbon atoms, $R^4$ is an alkylene group containing 1 to 5 carbon atoms and n is 1 to 10; and, at least one alkyl-substituted phenol wherein the alkyl is branched, contains from 16 to 40 carbon atoms and is derived from a 1-olefin oligomer containing from 8 to 12 carbon atoms, the reaction being carried out from about 60° C. to about 130° C. using the reactants in a respective molar ratio of 1.0–2.0:1.0–2.0:1.0.

2. The method of claim 1 wherein the alkyl-substituted phenol is represented by the formula

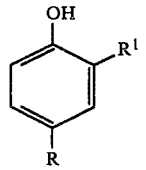

wherein R represents the alkyl of from 16 to 40 carbon atoms and $R^1$ is hydrogen or R.

3. The method of claim 2 wherein the alkyl-substituted phenol prior to substitution with the alkyl group is phenol, cresol, xylitol, hydroxydiphenyl, amylphenol, benzylphenol, alpha naphthol or beta naphthol.

4. The method of claim 1 wherein the aldehyde is represented by the formula $$R^3CHO$$

wherein $R^3$ is hydrogen, a hydrocarbyl group containing from 1 to 10 carbon atoms or a hydrocarbyl group containing from 1 to 10 carbon atoms and substituted with a halogen atom or hydroxyl group.

5. The method of claim 1 wherein the aldehyde is an aromatic, aliphatic or heterocyclic aldehyde.

6. The method of claim 1 wherein the aldehyde is formaldehyde, paraformaldehyde, acetaldehyde, aldol beta-hydroxybutyraldehyde, benzaldehyde or furfural.

7. The method of claim 1 wherein the amine is cocoamine, oleylamine, octylamine, nonylamine, decylamine, cyclooctylamine, dodecylamine, tetradecylamine, hexadecylamine, octadecylamine, stearylamine, laurylamine, soyamine, dibutylamine, dioctylamine, ethanolamine, diethanolamine, dimethylenetriamine, diethylenetriamine, triethylenetetramine, tetraethylenepentamine, hexaethyleneheptamine, ethylenediamine, propylenediamine, cyclohexylamine or dicyclohexylamine.

8. The method of claim 1 wherein the alkyl substituted phenol is derived from the alkylation of phenol with 1-decene, the aldehyde is paraformaldehyde and the amine is cocoamine.

9. A liquid lubricating oil composition which comprises a liquid lubricating oil and a coefficient of friction-reducing amount of the product resulting from reacting an aldehyde;

at least one amine selected from the group consisting of primary amines containing from 8 to 18 carbon atoms and polyalkylenepolyamines of the formula $$NHX(R^4NH)_nR^2$$

wherein $R^2$ and X are selected from the group consisting of hydrogen, a hydrocarbyl group and a hydroxyhydrocarbyl group, either containing 6 to 18 carbon atoms, $R^4$ is an alkylene group containing 1 to 5 carbon atoms and n is 1 to 10; and, at least one alkyl-substituted phenol wherein the alkyl is branched, contains from 16 to 40 carbon atoms and is derived from a 1-olefin oligomer containing from 8 to 12 carbon atoms, the reaction being carried out from about 60° C. to about 130° C. using the reactants in a respective molar ratio of 1.0–2.0:1.0–2.0:1.0.

10. The lubricating oil composition of claim 9 wherein the alkyl-substituted phenol is represented by the formula

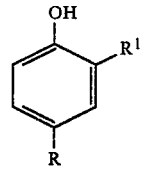

wherein R represents the alkyl of from 16 to 40 carbon atoms and $R^1$ is hydrogen or R.

11. The lubricating oil composition of claim 10 wherein the alkyl-substituted phenol prior to substitution with the alkyl group is phenol, cresol, xylitol, hydroxydiphenyl, amylphenol, benzylphenol, alpha naphthol or beta naphthol.

12. The lubricating oil composition of claim 9 wherein the aldehyde is represented by the formula $$R^3CHO$$

wherein $R^3$ is hydrogen, a hydrocarbyl group containing from 1 to 10 carbon atoms or a hydrocarbyl group containing from 1 to 10 carbon atoms and substituted with a halogen atom or hydroxyl group.

13. The lubricating oil composition of claim 9 wherein the aldehyde is an aromatic, aliphatic or heterocyclic aldehyde.

14. The lubricating oil composition of claim 9 wherein the aldehyde is formaldehyde, paraformaldehyde, acetaldehyde, aldol beta-hydroxybutyraldehyde, benzaldehyde or furfural.

15. The lubricating oil composition of claim 9 wherein the amine method of claim 1 wherein the amine is cocoamine, oleylamine, octylamine, nonylamine, decylamine, cyclooctylamine, dodecylamine, tetradecylamine, hexadecylamine, octadecylamine, stearylamine, laurylamine, soyamine, dibutylamine, dioctylamine, ethanolamine, diethanolamine, dimethylenetriamine, diethylenetriamine, triethylenetetramine, tetraethylenepentamine, hexaethyleneheptamine, ethylenediamine, propylenediamine, cyclohexylamine or dicyclohexylamine.

16. The lubricating oil composition of claim 9 wherein the alkyl substituted phenol is derived from the alkylation of phenol with 1-decene, the aldehyde is paraformaldehyde and the amine is cocoamine.

* * * * *